United States Patent [19]

Punater

[11] 3,965,819

[45] June 29, 1976

[54] INK DUCTOR SYSTEM

[75] Inventor: Dinesh G. Punater, Kettering, Ohio

[73] Assignee: Harris Corporation, Cleveland, Ohio

[22] Filed: Jan. 31, 1975

[21] Appl. No.: 545,778

[52] U.S. Cl. ..... 101/350; 101/DIG. 6

[51] Int. Cl.[2] ..... B41F 31/10

[58] Field of Search ..... 101/DIG. 6, 348–352, 101/206–209; 74/570, 571 R

[56] References Cited

UNITED STATES PATENTS

| | | | |
|---|---|---|---|
| 1,816,796 | 7/1931 | Rossger | 101/218 |
| 1,816,948 | 8/1931 | Wood | 101/348 |
| 2,474,160 | 6/1949 | Peyrebrune | 101/DIG. 6 |
| 2,568,761 | 9/1951 | Peyrebrune | 101/218 |
| 2,639,666 | 5/1953 | Halley | 101/247 |
| 2,653,539 | 9/1953 | Halley | 101/352 |
| 3,491,686 | 1/1970 | Zurick | 101/352 |
| 3,605,617 | 9/1971 | Wieland | 101/218 |

*Primary Examiner*—J. Reed Fisher

*Attorney, Agent, or Firm*—Biebel, French & Nauman

[57] ABSTRACT

An inker for a printing press, utilizing an oscillating ductor roll, is provided with an adjustable eccentric member for setting the ductor roll to the fountain roll. The eccentric member is provided with a releasable mechanism which will permit continued contact between the ductor and fountain rolls, as during make-ready operations, without affecting the adjustment of the eccentric member. This prevents ink transfer to the distributor and other inking rolls during the make-ready operations.

1 Claim, 4 Drawing Figures

INK DUCTOR SYSTEM

BACKGROUND OF THE INVENTION

This invention relates to inking mechanism for a printing press, and particularly to an improved ductor apparatus of the oscillating type which is adapted to transfer a "stripe" of ink from a fountain roll to the first of a series of distributor rolls from whence the ink is eventually applied to a printing plate. Particularly in lithographic printing presses the ink employed is a rather thick viscous grease-like material which must be precisely metered and distributed in order to achieve uniform proper inking of the printing plate.

A typical ink fountain includes a fountain roller which may be driven at variable speeds, and which is mounted to form one wall of the ink fountain which holds a supply of the thick viscous ink. Sides of the fountain confine the ink within the length of the fountain roll, and the bottom of the fountain is conventionally formed by a flexible blade or plate which extends upwardly and away from adjacent the lower end of the fountain roll, between the sides. The framework of the fountain supports a number of adjusting thumb screws which press against the edge of the blade, near the fountain roll, in order to adjust that edge precisely with respect to the surface of the fountain roll and thereby to control precisely the metering edge or slit between the blade and the roll, through which the film of ink is formed on the fountain roll. During makeready operations, the press operator adjusts these thumb screws while observing the thickness and continuity of the film of ink on the fountain roll, in order to achieve the desired film of ink thereon.

During press operation the ductor roll is oscillated such that a portion of its surface first contacts the fountain roll and picks up a "stripe" of ink, and then the ductor roll is moved away from the fountain roll and into contact with the first distributor roll, where the stripe of ink is applied to the distributor roll, and through the succession of distributor rolls and vibrating rolls making up the inker (sometimes called the inking tower) which carries the ink to the plate. Mechanism for oscillating the ductor is conventionally provided in the form of oscillating links, including pivoted arms carrying opposite ends of the ductor roll and connected to cam mechanism which controls the motion of the ductor. This linkage includes adjustments for controlling precisely the contact of the ductor with the first distributor roll, and also contact between the ductor and the fountain roll.

During makeready operations the fountain blade is set relative to the fountain roll with adjustable thumb screws to provide the correct amount of ink supply to the plate on the press. Areas on a plate with heavy coverage require more ink than area with light coverage. This adjustment is accomplished while the ductor roll is set against the fountain roll and the thumb screws are adjusted while the pressman observes the ink film formed on the fountain roll.

There are two ways to achieve the desired ductor position during this operation. One is to stop the press with the ductor roll against the fountain roll, then turn the fountain roll manually during the adjusting operation. Many presses have a ratchet-lever and overrunning clutch for this purpose. On wide presses, particularly using viscous inks, it is difficult to turn the fountain roll by hand, even with such lever mechanism.

Some presses are provided with an auxiliary drive for wash-up and makeready operations. For example, in a multi-color press with a main line shaft drive, clutches are provided to disengage each impression cylinder from the line shaft. Auxiliary drive motors are connected through suitable clutches to each plate cylinder, and through the gearing drive the blanket cylinders and other rollers, etc., of the associated inker. Where motor driven dampener rollers are used, this same motor may function as the auxiliary motor.

During makeready, the auxiliary drive motor is used to rotate the inker, but this also oscillates the ductor and loads up the inking rollers since the press is off impression. This results in a considerable power demand on the auxiliary motor, sometimes overloading it, and after makeready the inking rollers have to be washed up before printing can begin.

SUMMARY OF THE INVENTION

The present invention provides an improvement in the ductor apparatus, and particularly in the adjustment and drive for oscillating the ductor, whereby during makeready the line contact or "stripe" contact of the ductor to the fountain roll can be established, as can the contact desired between the ductor and the distributor roll, and once these adjustments are made the mechanism for oscillating the ductor can be altered, without losing the adjustment, to permit the ductor to continue to contact the fountain roll as the operator adjusts the fountain, while preventing the ductor transferring ink picked up during this part of the makeready process onto the distributor roll. Then when makeready is completed, and the press is ready to print, the mechanism can be returned to the adjusted position and the transfer of ink through the tower, i.e., the various distributor and vibrating rolls, can commence as the press begins to run, without loading up the inking tower prior to that time.

Specifically, the cam-linkage drive for the oscillating arms which carry the ductor includes an eccentric adjustment, per se conventional, and this eccentric adjustment is provided with a quick release mechanism that permits temporary mis-alignment of the eccentric adjustment, without destroying the precise adjustment thereof. Return of this quick release mechanism into its normal engaged position reinstates the precise adjustment of the eccentric mechanism and thus re-establishes the adjusted condition of the ductor oscillating apparatus.

The primary object of the invention, therefore, is to provide a novel improvement in an inker for a printing press, whereby an oscillating ductor is precisely adjusted to the fountain roll and distributor roll, and wherein this adjustment may be temporarily altered without losing the accuracy of the adjustment, enabling it to be restored to the precise condition after makeready is completed, and thereby enabling the makeready operation on the fountain, and the fountain-ductor relation, without loading the remainder of the inking tower with ink.

Other objects and advantages will be apparent from the following description, the accompanying drawings and the appended claims.

Figure 1:
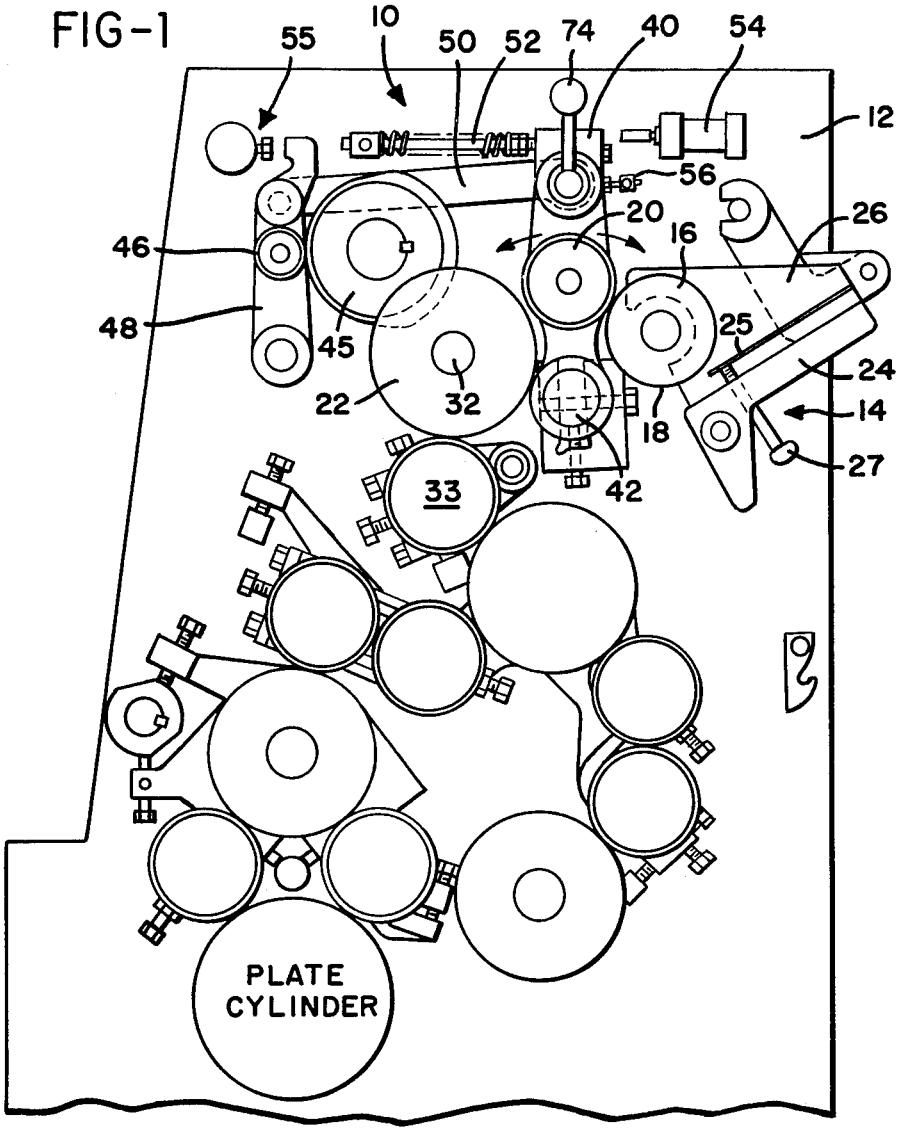
FIG. 1 is a somewhat schematic side view of an inker for a printing press, embodying the novel adjustment feature of the invention.
Figure 2:
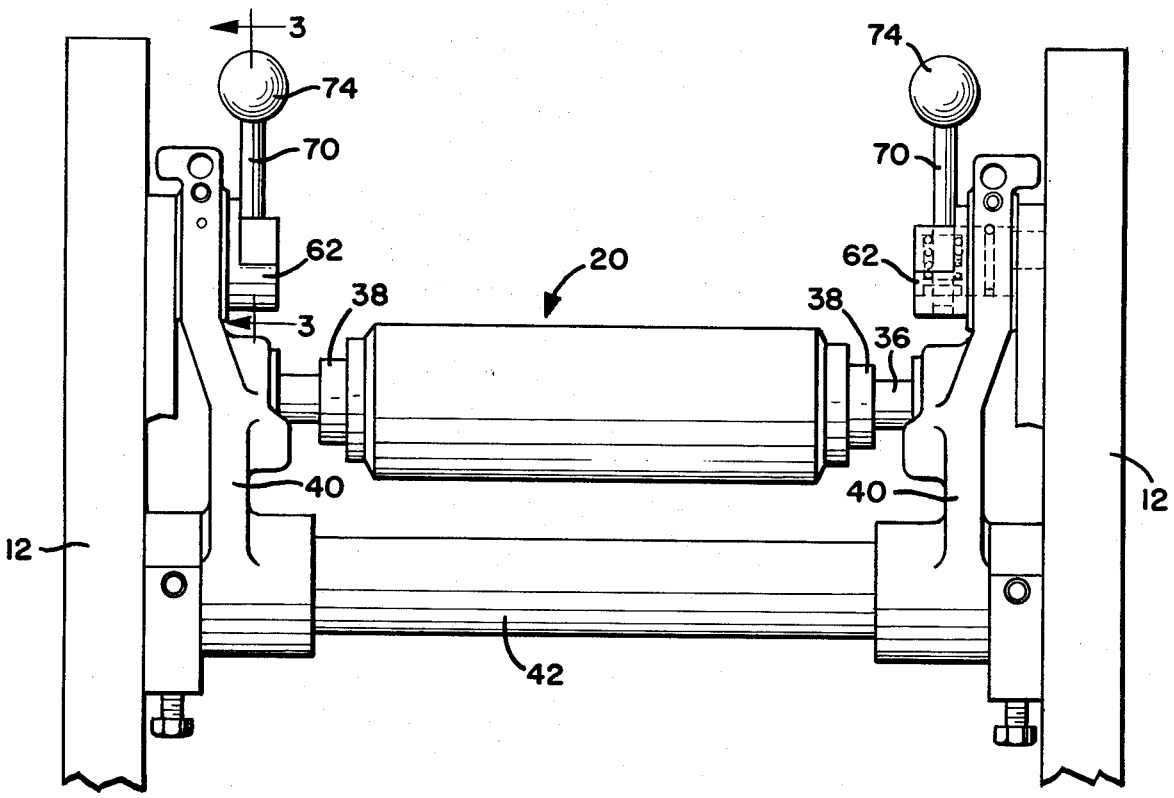
FIG. 2 is a view showing the support for the oscillating ductor, and the novel quick release eccentric mechanism.

As representing one embodiment of the present invention, FIGS. 1 and 2 of the drawings show the roller lay out and one side operating linkage for the inking mechanism 10. The inking mechanism 10 is adapted to be disposed between and supported by a pair of spaced side frames 12 of the printing press. The inking mechanism 10, in the preferred embodiment, generally comprises an ink fountain 14 having a fountain roll 16 for carrying a film of ink on its outer peripheral surface 18, a ductor roll 20 which picks up ink from the fountain roll 16 for carrying a film of ink on its outer peripheral surface 18, and a transfer or distributor roll 22 for receiving the ink from the ductor roll 20. The ink film on the roll 22 is adapted to be transferred to the plate cylinder of the printing press via a series of intermediate transfer rolls, including vibrating rolls, and in a manner well known to those skilled in the art.

The ink fountain 14 may be of any suitable or conventional construction. It is suitably supported by the side frames 12 and comprises a fountain body or support means 24 having a flexible bottom blade or plate 25 and upwardly extending sides 26 at its opposite ends which rotatably support the opposite ends of the fountain roll 16. The sides 26, bottom 25 and fountain roll 16 define a trough for holding a supply of ink in contact with the outer periphery 18 of the fountain roll 61. Thumb screws 27, mounted in the fountain, press against blade 25 at spaced intervals.

The ductor roll 20 picks up ink from the outer peripheral surface 18 of the fountain roll 16 and in turn transfers the ink to the first distributor roll 22. The roll 22 is preferably a metal cylindrical roll with a hard rubber covering, and has journals on its ends fitted in suitable conventional bearings in the side frames 12 for rotation about an axis extending parallel to the axis of rotation to the fountain roll 16. The roll 22 is adapted to be rotated in either direction by a suitable conventional drive means, such as the main drive means of the printing press or by friction from the roll 33 to which it supplies the ink. The roll 22, in the preferred embodiment, is in peripheral contact with the ductor roll 20 to rotate the latter. The distributor and ductor rolls are normally rotated at the surface speed of the printing cylinder, while the fountain roll 16 is rotated at a substantially slower speed. The rate of rotation of the fountain roll 16 is preferably adjustable to supply the amount of ink required, and the drive thereto may be intermittent.

The ductor roll 20 is rotatably journaled on a shaft 36 by bearings 38. Opposite ends of the shaft 36 are supported in arm members 40 (FIG. 2) which are in turn mounted to a cross shaft 42 which extends between the side plates 12, and is suitably supported to rotate about a fixed axis. It is the rocking or oscillating motion of the arms 40 which carries the ductor 20 between positions where it alternately contacts fountain roll 16 and the first distributor roll 22. This motion of the arms 40 is produced by a cam 45 each side which is suitably rotated from the press drive, and which engages a follower roller 46 on pivotally mounted arms 48. Arms 48 are connected to arms 40 by links 50, and this connection may be suitably adjusted, as will be explained, for precise control of the motion of the ductor. A spring loaded rod 52 pushes against arm 40, and through link 50 acts to hold follower 46 engaged with cam 45. This engagement may be overcome by actuation of a throw-off cylinder 54 whose rod can extend into contact with the arm 40, overcoming the spring loaded rod 52, and shifting the entire linkage so that the follower 46 is held away from cam 45, and thus stopping the oscillating movement of the ductor. This feature is available for washup operations, as when changing ink or cleaning up the press. The extent of this throw off movement can be adjusted by a suitable stop 55. A stop 56 adjusts the contact of the ductor and fountain rolls. All of this mechanism is conventional in inkers heretofore supplied.

The essence of the present invention lies in the modification of an eccentric adjustment provided between link 50 and arm 40. Details of these parts are shown particularly in an exploded view, FIG. 4. Heretofore it has been customary to provide an eccentric connection in the form of a cross pin which was mounted to rotate within the end of link 50, and which had a suitable cylindrical surface, eccentric to the axis of rotation of the pin in the link, which eccentric surface was received in an appropriate journal in the arm 40. The end of the arm was split, and this split end connected by a suitable clamping bolt, such that appropriate rotation of the connecting pin would produce eccentric motion that altered the relative positions of arm 40 and link 50 at each side. This adjustment has conventionally been used for the purpose of obtaining exact parallelism between the surface of the ductor and the fountain roll 16, in particular, and to control the amount of transferring pressure exerted by the rubber or other compressible cover on the ductor against the fountain roll, and against the distributor roll.

Figure 3:
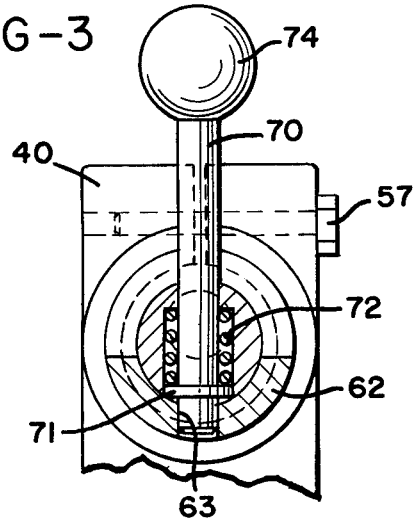
FIG. 3 is a partial cross-sectional view, on a somewhat enlarged scale, taken on lines 3—3 in FIG. 2.
Figure 4:
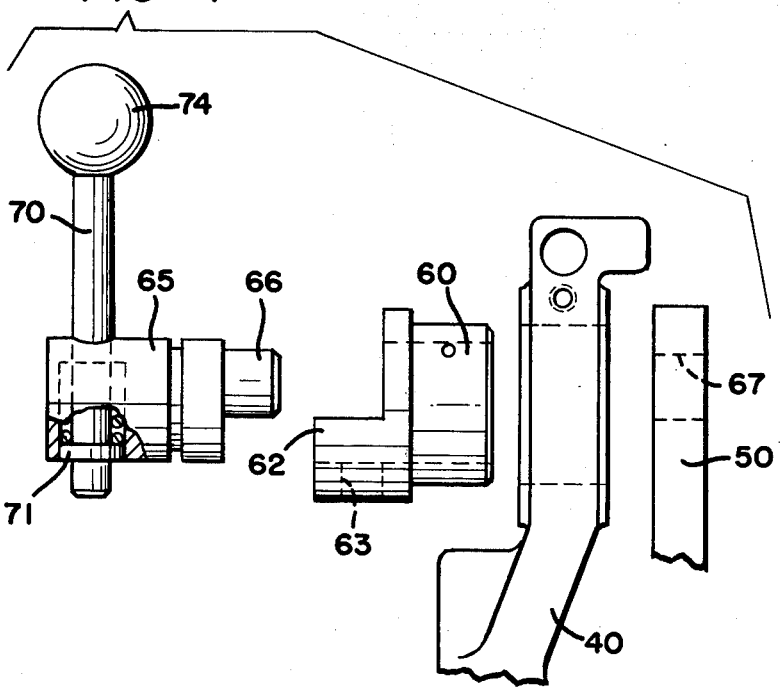
FIG. 4 is an exploded view illustrating the parts of a novel eccentric mechanism and the quick release feature.

In accordance with the invention, the end of each link 40 is still split, as shown particularly in FIGS. 3 and 4, and the clamping bolt 57 is provided at this point to draw the split ends of the arm together. The bushing 60 is provided as a cylindrical surface suitably journaled in the split end of arm 40. The outer end of this bushing is provided with a laterally extending lip 62, of approximately 180° extent, and having a transverse socket or hole 63 approximately midway between its ends. This entire bushing is rotatable within the split end of arm 40, and can be released for rotation by backing off the bolt 52, and can be clamped in an adjusted position by tightening that bolt.

The bushing 60 has a central bore receiving the eccentric pin member 65, which is rotatable within the bushing 60. The end of the eccentric pin member 65 is provided with a cylindrical stud 66 of smaller diameter, having an axis offset from the central axis of the member 65, and hence the axis of bushing 60. The end 66 is of an appropriate size to fit within a bore 67 formed in the end of link 40.

A quick releasing interconnection between bushing 60 and pin member 65 is provided by a transverse rod 70 provided with a guiding collar 71, and suitably supported for cross sliding motion within the member 65. A spring 72 is mounted internally of the cross passage in the member 65, and acts against the collar 71, urging the rod 70 outward to the position shown in FIG. 3, where the end of the rod engages within the socket 63 of the bushing 60. A suitable handle 74 is attached to the other end of rod 70 to facilitate grasping and manipulating it.

Thus, during setting up operations, the pin 70 is interlocked with bushing 60, and if the bolt 57 is released, the parts 60 and 65 rotate together, functioning as the usual eccentric adjustment arrangement between arm 40 and link 50. It will be seen that rotation of bushing 60 and the member 65 within it will produce eccentric motion of the offset end 66 which is within the bore 67 of link 50, thereby adjusting the relative positions of the link and the arm. This adjustment is made in the usual way to adjust the surface of the ductor roll to the fountain roll, in particular, then the clamping bolts 57 are tightened to maintain the adjustment.

During makeready operations, when the press operator is adjusting the thumb screws 27 to adjust the flexible plate-like bottom of the fountain, it is desirable for reasons already explained to hold the ductor away from the distributor roll 22 and in contact with fountain roll 16, even though cam 45 may be rotating since the inker mechanism is being turned over to rotate roll 16 during the makeready operation. To accomplish this, the operator merely pulls up on the handle 74 to release the pins 70 from bushing 60, and using the handles, the operator appropriately rotates the members 65 within the bushing 60, thereby causing the eccentric to alter the positions of arms 40 relative to links 50 on a temporary basis. The edges of the lip 62 may provide a suitable stop to limit the rotational movement of the members 65 within the bushing 60. When the makeready operation is completed, the operator grasps the handle 74 and moves the pin 70 into alignment with the socket 63 in the bushings whereby the spring loaded pins engage in its sockets and return the eccentric mechanism precisely to the previously adjusted position.

While the form of apparatus herein described constitutes a preferred embodiment of this invention, it is to be understood that the invention is not limited to this precise form of apparatus, and that changes may be made therein without departing from the scope of the invention.

What is claimed is:

1. In an inker for a printing press having a fountain roll and a distributor roll mounted in spaced parallel relation, a ductor roll, pivotally mounted support arms carrying said ductor roll parallel to and between said fountain and distributor rolls, drive linkage connected to said arms to oscillate said ductor roll into contact alternately with said fountain and distributor rolls, throw off means operable on said drive linkage to prevent its moving said ductor roll into contact with said fountain roll, and an adjustable connection between said arms and said drive linkage to adjust precisely the area of contact between said ductor roll and said fountain roll;

the improvement comprising means incorporated in said adjustable connection to change the relative positions of said arms and said drive linkage temporarily without disturbing the setting of said adjustable connection whereby contact between said ductor roll and said distributor roll can be avoided during makeready periods, said adjustable connection including eccentric members having a circular stud portion forming a rotatable connection to said linkage and having a circular body portion offset from said stud portion, bushings rotatably mounted in said arms and surrounding said body portions of said eccentric members, a releasable connection between said bushings and said eccentric members defining a predetermined positional relation therebetween permitting temporary rotation between said bushings and said eccentric members, and means clamping said bushings in said arms whereby said bushings and eccentric members can be rotated together and secured in an adjusted position defining the relation of said arms to said linkage.

* * * * *